US009151230B2

(12) United States Patent
Demory

(10) Patent No.: US 9,151,230 B2
(45) Date of Patent: Oct. 6, 2015

(54) METHOD FOR CONTROLLING A DIESEL ENGINE SYSTEM

(75) Inventor: Romain Demory, London (GB)

(73) Assignee: Ford Global Technologies, LLC, Dearborn, MI (US)

( * ) Notice: Subject to any disclaimer, the term of this patent is extended or adjusted under 35 U.S.C. 154(b) by 892 days.

(21) Appl. No.: 13/407,639

(22) Filed: Feb. 28, 2012

(65) Prior Publication Data

US 2012/0226429 A1 Sep. 6, 2012

(30) Foreign Application Priority Data

Mar. 3, 2011 (GB) ..... 1103596.1

(51) Int. Cl.

| | |
|---|---|
| ***F02D 41/30*** | (2006.01) |
| ***F02D 41/26*** | (2006.01) |
| ***F02D 28/00*** | (2006.01) |
| ***F02D 11/10*** | (2006.01) |
| *F02D 41/14* | (2006.01) |

(52) U.S. Cl.

CPC ..... *F02D 11/105* (2013.01); *F01N 2900/1606* (2013.01); *F02D 2041/1432* (2013.01); *F02D 2200/0812* (2013.01); *F02D 2250/11* (2013.01); *F02D 2250/21* (2013.01); *F02D 2250/38* (2013.01)

(58) Field of Classification Search

CPC ..... F02D 11/105; F02D 2250/38; F02D 2250/11; F02D 41/029; F02D 2200/0812

USPC ..... 701/102–104; 60/274, 277, 285, 286, 60/295, 297, 311

See application file for complete search history.

(56) References Cited

U.S. PATENT DOCUMENTS

| | | | | |
|---|---|---|---|---|
| 7,433,776 | B1 * | 10/2008 | Hunter et al. | 701/102 |
| 2006/0254262 | A1 * | 11/2006 | Chiba et al. | 60/295 |
| 2007/0068147 | A1 | 3/2007 | Sun et al. | |
| 2008/0016865 | A1 | 1/2008 | Ramamurthy | |
| 2008/0154478 | A1 * | 6/2008 | Lyons | 701/102 |
| 2008/0295491 | A1 * | 12/2008 | Kuboshima et al. | 60/285 |
| 2009/0266055 | A1 | 10/2009 | Guo et al. | |
| 2011/0162620 | A1 * | 7/2011 | Bidner et al. | 701/103 |

FOREIGN PATENT DOCUMENTS

| | | | |
|---|---|---|---|
| DE | 102005000978 | A1 | 7/2006 |
| EP | 2143903 | A1 | 7/2008 |
| GB | 2475319 | A | 11/2009 |
| JP | 2008057333 | A | 3/2008 |
| KR | 20100009782 | A | 1/2010 |
| WO | 2007122470 | A2 | 11/2007 |
| WO | 2007145553 | A1 | 12/2007 |

* cited by examiner

*Primary Examiner* — Hieu T Vo
*Assistant Examiner* — Arnold Castro
(74) *Attorney, Agent, or Firm* — Julia Voutyras; Alleman Hall McCoy Russell & Tuttle LLP

(57) ABSTRACT

A method for controlling a diesel engine is disclosed in which the diesel engine is controlled to produce less soot when the operating state of an associated emission control device such as a diesel particulate filter or the amount of a contaminant such as fuel or soot in the oil used to lubricate the diesel engine exceed predetermined respective thresholds.

14 Claims, 6 Drawing Sheets

METHOD FOR CONTROLLING A DIESEL ENGINE SYSTEM

RELATED APPLICATIONS

The present application claims priority to United Kingdom Patent Application No. 1103596.1, filed on Mar. 3, 2011, the entire contents of which are hereby incorporated by reference for all purposes.

FIELD

The present disclosure relates to the control of a diesel engine and, in particular, to the control of such an engine in order to selectively reduce the production of soot by the engine.

BACKGROUND AND SUMMARY

It is well known that, if a sudden demand for increased torque is received by a diesel engine, a large amount of soot will be produced by the engine due to mis-fuelling of the engine. That is to say, to meet the requested torque demand a specific amount of fuel is required but the amount of ingested air is initially lower than that required to efficiently combust this volume of fuel due to the low initial speed of the engine. The result of this mis-fuelling is the production of soot from the engine due to the inefficient and incomplete combustion that takes place.

This mis-fuelling is disadvantageous in several respects. Firstly, fuel is wasted and therefore the fuel economy of the engine is reduced, secondly, unnecessary emissions are produced including the above referred to soot, thirdly, over fuelling produces un-burnt fuel in the engine which is absorbed into the lubricating oil, and fourthly, the soot produced rapidly fills any particulate filter provided to remove the soot from the exhaust gasses of the engine.

One approach to this problem includes restricting the amount of soot that is produced during such a transient event by modifying the target torque to be provided by the engine. However, a relatively high level of soot is still produced because an overall objective is to minimize the loss of potential torque output obtainable from the engine. A large amount of fuel or soot in the oil will reduce the lubricating properties of the oil. Furthermore, if the amount of fuel in the oil becomes very high, this high level of fuel in the oil can lead to engine runaway if the highly combustible fuel/oil mix is ingested back into the engine via an engine breather system.

The soot loading of a diesel particulate filter (DPF) affects the efficient operation of a diesel engine because as the DPF fills with soot the back pressure on the engine increases and so the torque output attainable from the engine will tend to drop. Therefore, a DPF may be regularly regenerated by burning off the soot stored in it. To do this, fuel is injected into the engine late in the combustion cycle so that un-burnt fuel travels towards the DPF where it auto-ignites in an upstream catalyst before entering the DPF and the exhaust gases at an increased temperature enter the DPF and burn off the soot. However, this process has two main disadvantages. Firstly, fuel is wasted regenerating the DPF, and secondly, the late injection of the fuel often result in un-burnt fuel impinging against the cylinder wall of the engine where it is readily absorbed into the oil thereby increasing the amount of fuel in the oil.

The inventors have recognized the issues with the above approaches and offer a method to at least partly address them. In one embodiment, there is provided a method for controlling an engine system having a diesel engine, at least one emission control device and oil to lubricate the engine, the method comprising adaptively varying an operation of the engine to reduce the production of soot by the engine based upon at least one of the current state of the emission control device and the current state of the oil of the engine.

In this way, the soot production of a diesel engine is adaptively reduced so as to increase the time periods between DPF regeneration events, thereby reducing the amount of fuel used during the life of the diesel engine for these events. The present disclosure may offer several advantages. For example, decreased fuel consumption in DPF regeneration may result in enhanced fuel economy and decreased soot production may result in decreased emissions.

The above advantages and other advantages, and features of the present description will be readily apparent from the following Detailed Description when taken alone or in connection with the accompanying drawings.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1:
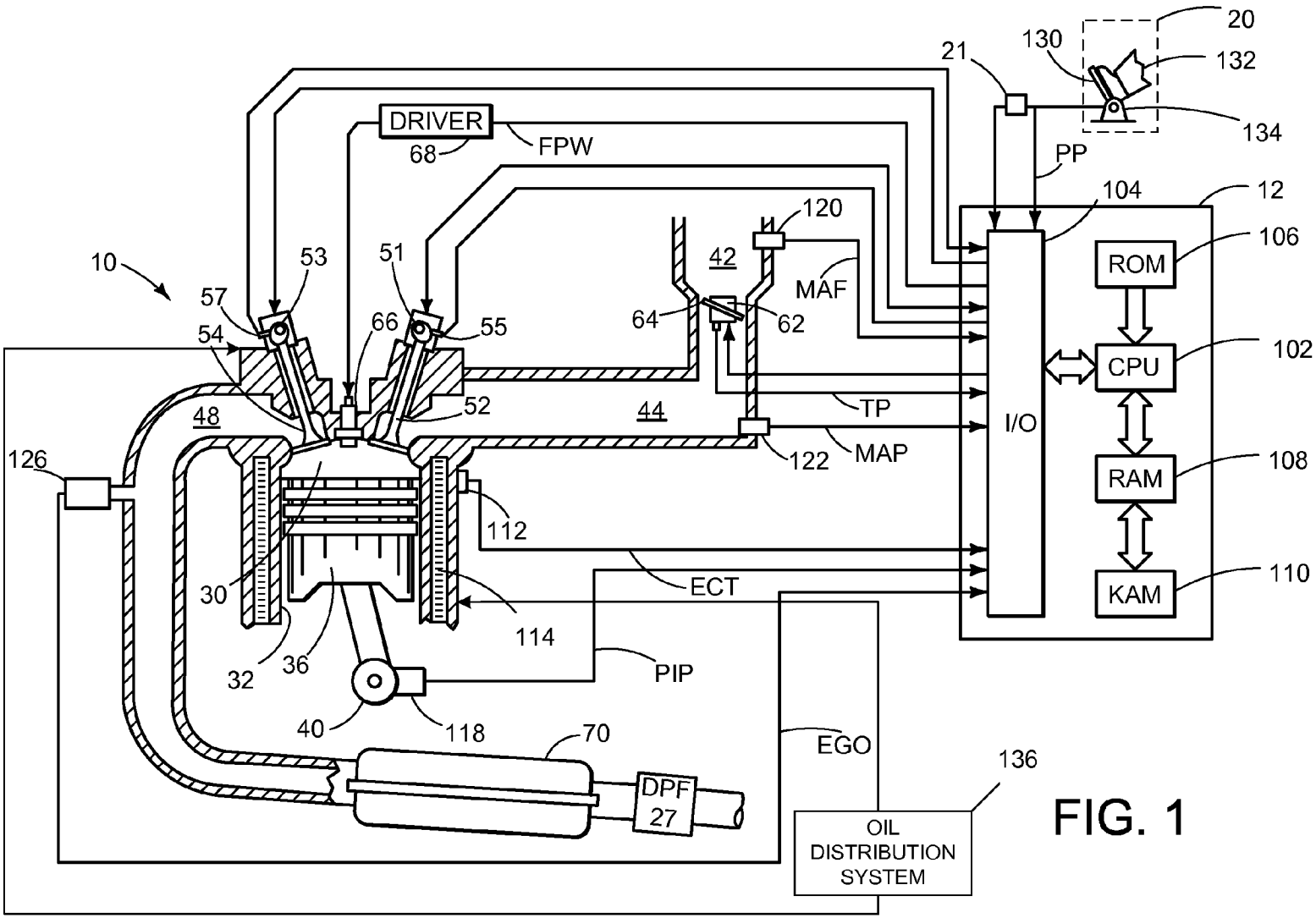
FIG. 1 is a schematic diagram showing one cylinder of a multi-cylinder diesel engine.

FIG. 1 is a schematic diagram showing one cylinder of multi-cylinder engine 10, which may be included in a propulsion system of an automobile. Engine 10 may be controlled at least partially by a control system including controller 12 and by input from a vehicle operator 132 via an input device 130. In this example, input device 130 includes an accelerator pedal and a pedal position sensor 134 for generating a proportional pedal position signal PP. Combustion chamber (i.e., cylinder) 30 of engine 10 may include combustion chamber walls 32 with piston 36 positioned therein. Piston 36 may be coupled to crankshaft 40 so that reciprocating motion of the piston is translated into rotational motion of the crankshaft. Crankshaft 40 may be coupled to at least one drive wheel of a vehicle via an intermediate transmission system. Further, a starter motor may be coupled to crankshaft 40 via a flywheel to enable a starting operation of engine 10. A lubrication system in the form of oil distribution system 136 may be provided to direct oil to lubricate the engine 10. Combustion chamber 30 may receive intake air from intake manifold 44 via intake passage 42 and may exhaust combustion gases via exhaust passage 48. Intake manifold 44 and exhaust passage 48 can selectively communicate with combustion chamber 30 via respective intake valve 52 and exhaust valve 54. In some embodiments, combustion chamber 30 may include two or more intake valves and/or two or more exhaust valves.

In this example, intake valve 52 and exhaust valves 54 may be controlled by cam actuation via respective cam actuation systems 51 and 53. Cam actuation systems 51 and 53 may each include fixed cam timing, or may include one or more cams and may utilize one or more of cam profile switching (CPS), variable cam timing (VCT), variable valve timing (VVT) and/or variable valve lift (VVL) systems that may be operated by controller 12 to vary valve operation. The position of intake valve 52 and exhaust valve 54 may be determined by position sensors 55 and 57, respectively. In alternative embodiments, intake valve 52 and/or exhaust valve 54 may be controlled by electric valve actuation. For example, cylinder 30 may alternatively include an intake valve controlled via electric valve actuation and an exhaust valve controlled via cam actuation including CPS and/or VCT systems.

Fuel injector 66 is shown coupled directly to combustion cylinder 30 for injecting fuel directly therein in proportion to the pulse width of signal FPW received from controller 12 via electronic driver 68. In this manner, fuel injector 66 provides what is known as direct injection of fuel into combustion cylinder 30. The fuel injector may be mounted on the side of the combustion cylinder or in the top of the combustion cylinder, for example. Fuel may be delivered to fuel injector 66 by a fuel delivery system (not shown) including a fuel tank, a fuel pump, and a fuel rail. In some embodiments, combustion cylinder 30 may alternatively or additionally include a fuel injector arranged in intake passage 42 in a configuration that provides what is known as port injection of fuel into the intake port upstream of combustion cylinder 30.

Intake passage 42 may include a charge motion control valve (CMCV) and a CMCV plate (not shown) and may also include a throttle 62 having a throttle plate 64. In this particular example, the position of throttle plate 64 may be varied by controller 12 via a signal provided to an electric motor or actuator included with throttle 62, a configuration that may be referred to as electronic throttle control (ETC). In this manner, throttle 62 may be operated to vary the intake air provided to combustion cylinder 30 among other engine combustion cylinders. Intake passage 42 may include a mass air flow sensor 120 and a manifold air pressure sensor 122 for providing respective signals MAF and MAP to controller 12.

Intake manifold 44 may include a throttle 62 having a throttle plate 64. However, in other examples, the throttle may be located in intake passage 42. In this particular example, the position of throttle plate 64 may be varied by controller 12 via a signal provided to an electric motor or actuator included with throttle 62, a configuration that is commonly referred to as electronic throttle control (ETC). In this manner, throttle 62 may be operated to vary the intake air and/or EGR provided to combustion chamber 30 among other engine cylinders. The position of throttle plate 64 may be provided to controller 12 by throttle position signal TP. Intake passage 42 may include a mass air flow sensor 120 and a manifold air pressure sensor 122 for providing respective signals MAF and MAP to controller 12.

In this embodiment the engine is a diesel engine configured to combust diesel fuel (e.g. petroleum diesel or bio-diesel) via compression ignition. Exhaust gas sensor 126 is shown coupled to exhaust passage 48 upstream of emission control device 70. Sensor 126 may be any suitable sensor for providing an indication of exhaust gas air/fuel ratio such as a linear oxygen sensor or UEGO (universal or wide-range exhaust gas oxygen), a two-state oxygen sensor or EGO, a HEGO (heated EGO), a $NO_x$, HC, or CO sensor. Emission control device 70 is shown arranged along exhaust passage 48 downstream of exhaust gas sensor 126. Device 70 may include a diesel oxidation catalyst (DOC) and a selective catalytic reduction (SCR) catalyst. An ammonia (or urea) delivery system may be coupled to the SCR catalyst or upstream of the SCR catalyst to deliver reductant to the SCR catalyst.

At least one diesel particulate filter (DPF) 27 may be coupled downstream of the emission control device 70. The DPF may be manufactured from a variety of materials including cordierite, silicon carbide, and other high temperature oxide ceramics. Once soot accumulation has reached a predetermined level (identified via pressure drop, for example), regeneration of the filter may be initiated. Filter regeneration may be accomplished by heating the filter to a temperature that will burn soot particles at a faster rate than the deposition of new soot particles, for example, 400-600° C. In one example, the DPF can be a catalyzed particulate filter containing a washcoat of precious metal, such as platinum, to lower soot combustion temperature and also to oxidize hydrocarbons and carbon monoxide to carbon dioxide and water.

Controller 12 is shown in FIG. 1 as a microcomputer, including microprocessor unit 102, input/output ports 104, an electronic storage medium for storing executable programs and calibration values shown as read only memory chip 106 in this particular example, random access memory 108, keep alive memory 110, and a data bus. The controller 12 may include non-transitory instructions stored on the electronic storage medium that, when executed by the microprocessor unit 102, perform programmed actions. The controller 12 may receive various signals and information from sensors coupled to engine 10, in addition to those signals previously discussed, including measurement of inducted mass air flow (MAF) from mass air flow sensor 120; engine coolant temperature (ECT) from temperature sensor 112 coupled to cooling sleeve 114; a profile ignition pickup signal (PIP) from Hall effect sensor 118 (or other type) coupled to crankshaft 40; throttle position (TP) from a throttle position sensor; and absolute manifold pressure signal, MAP, from sensor 122. Further, controller 12 may receive input from temperature sensor 112 and/or from another temperature sensor to determine a temperature of engine 10. Controller 12 may be used to facilitate the controlling of the production of soot in the engine 10 according to the present disclosure, as described in more detail below.

Distributorless ignition system 88 provides an ignition spark to combustion chamber 30 via spark plug 92 in response to controller 12. Universal Exhaust Gas Oxygen (UEGO) sensor 126 is shown coupled to exhaust manifold 48 upstream of catalytic converter 70. Alternatively, a two-state exhaust gas oxygen sensor may be substituted for UEGO sensor 126.

Converter 70 can include multiple catalyst bricks, in one example. In another example, multiple emission control devices, each with multiple bricks, can be used. Converter 70 can be a three-way type catalyst in one example.

As described above, FIG. 1 shows only one cylinder of a multi-cylinder engine, however it can be appreciated that and each cylinder may similarly include its own set of intake/exhaust valves, fuel injector, ignition system, etc.

Figure 2:
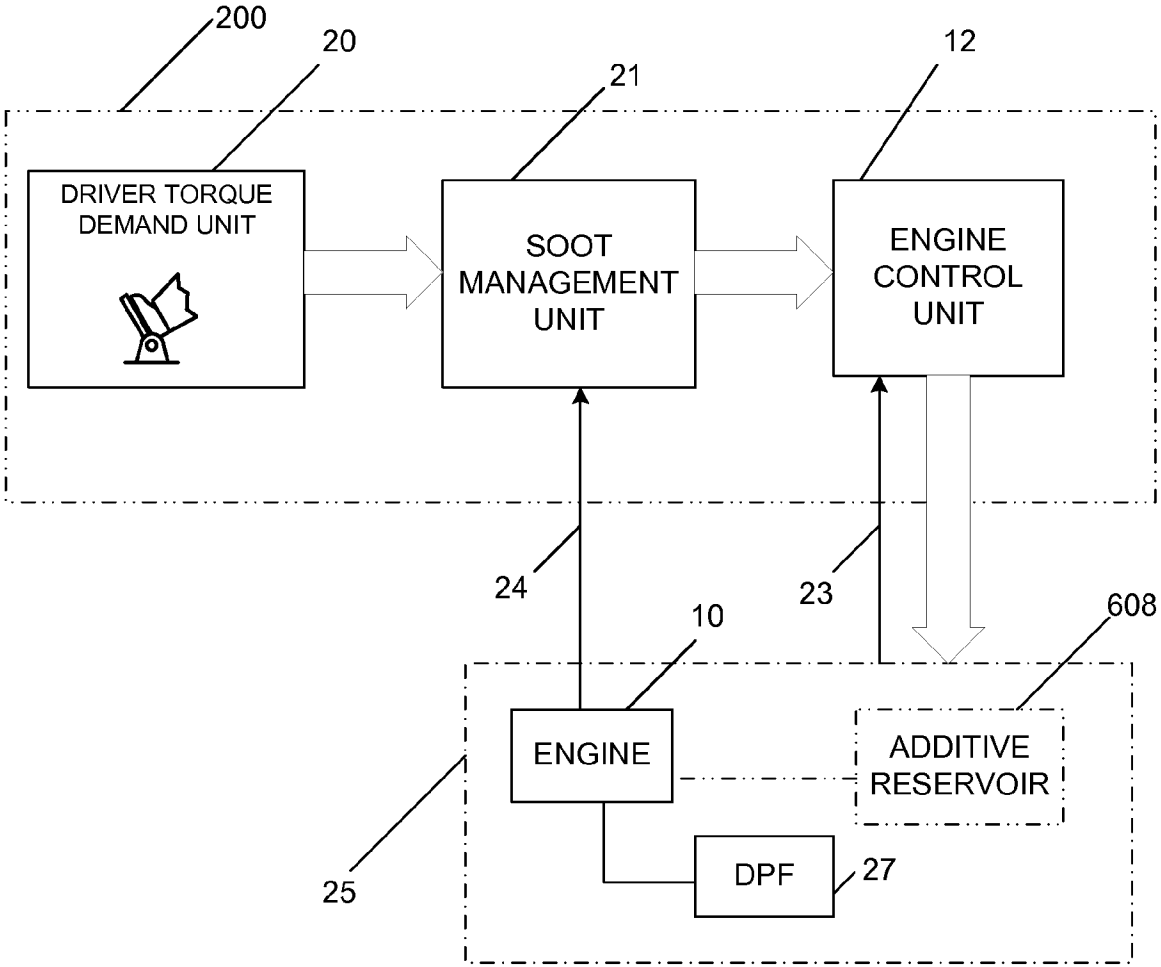
FIG. 2 is a schematic diagram of a control apparatus for the diesel engine of FIG. 1 according to one aspect of the present disclosure.

Turning to FIG. 2 there is shown an apparatus 200 for controlling a diesel engine 10 forming part of a diesel engine system 25 that also includes a diesel particulate filter 27 arranged to receive a flow of exhaust gas from the engine 10 and operable to filter out from the exhaust gas flowing therethrough soot produced by the engine 10.

The apparatus 200 includes a driver torque demand means 20, a soot management unit 21 and an engine control unit 12. In this case the driver torque demand means 20 is in the form of an accelerator pedal 130 and pedal sensor 134 that provides an output indicative of the position of the accelerator pedal 130. The sensor output is provided to the soot management unit 21 which is arranged to provide an output indicative of a permitted torque to the engine control unit 12. It will be appreciated that the soot management unit 21 and the engine control unit 12 could be formed as part of a main electronic controller and may not be separate units.

The soot management unit 21 receives from the diesel engine system 25 information 24 regarding the operating state of the diesel engine system such as, for example, the current rotational speed of the engine 10, as indicated by the arrow 24. The information 24 may also include information regarding one or more of the amount of fuel in the oil (FIO), the soot loading of the diesel particulate filter (DPF) 27, the mass airflow (MAF) into the engine 10 and the current air to fuel ratio. Alternatively, some of this information may be produced in the soot management unit 21 as estimated values.

The engine control unit 12 receives from the diesel engine system 25 information 23 regarding the operating state of the diesel engine system 25 such as, for example, the current rotational speed of the engine 10, the rotational position of the engine 10 relative to top dead centre or bottom dead centre, the mass airflow (MAF) into the engine 10 and the current air to fuel ratio as indicated by the arrow 23.

The received information 23 is used by the engine control unit 12 to control the operation of the engine 10 by controlling the fuelling of the engine 10 in terms of the volume of fuel to be injected, the timing of the injection of fuel and, in some cases, the number of injections to be used, and other engine operating parameters such as for example, the amount of exhaust gas recirculation, the air mass flow and the air charge pressure in the case of a boosted engine. The engine control unit 12 operates to fuel the engine 10 and to control these other engine operating parameters appropriately to meet the permitted torque demand and soot emission threshold received from the soot management unit 21. The soot production threshold may comprise an upper and lower soot production threshold, between which the operation of the engine 10 may be controlled.

Figure 5:
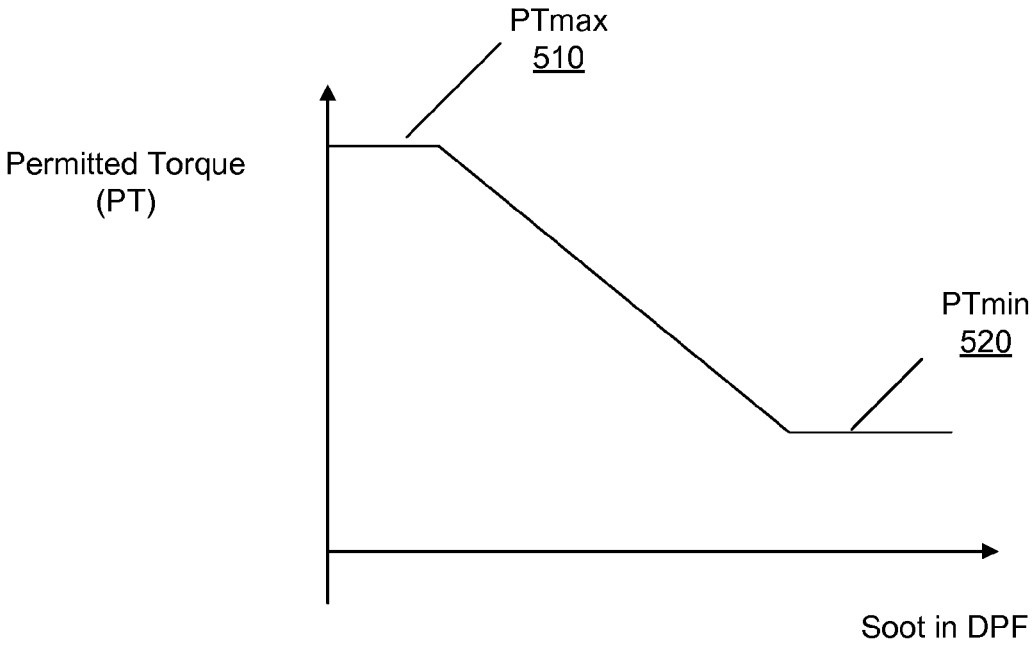
FIG. 5 is a diagrammatic chart showing for one operating state of the diesel engine of FIG. 1 a relationship between permitted torque and soot loading in a diesel particulate filter.

The soot management unit 21 is programmed to execute the method set out in FIG. 5 and in general terms is operable to reduce the level of permitted torque when either the soot loading of the DPF 27 exceeds a predetermined level or when the amount of fuel in the lubricating oil exceeds a predetermined level. In this way, the state of a soot affected parameter may be a current state of an emission control device and/or a current state of the lubrication oil of the engine 10. It will be appreciated that the soot management unit 21 could alternatively be arranged to permit a higher level of soot production if the soot loading of the DPF 27 is below a predetermined level and the amount of fuel in the lubricating oil is below a predetermined level. In either case, the soot management unit 21 is operable to adaptively vary the operation of the engine 10 during a transient phase of operation to control the production of soot by the engine 10 based upon at least one of the soot loading of the DPF 27 and the amount of fuel in the lubrication oil of the engine 10.

Referring now to FIGS. 3 to 6, the method used to control the soot production will be described in detail.

Figure 3:
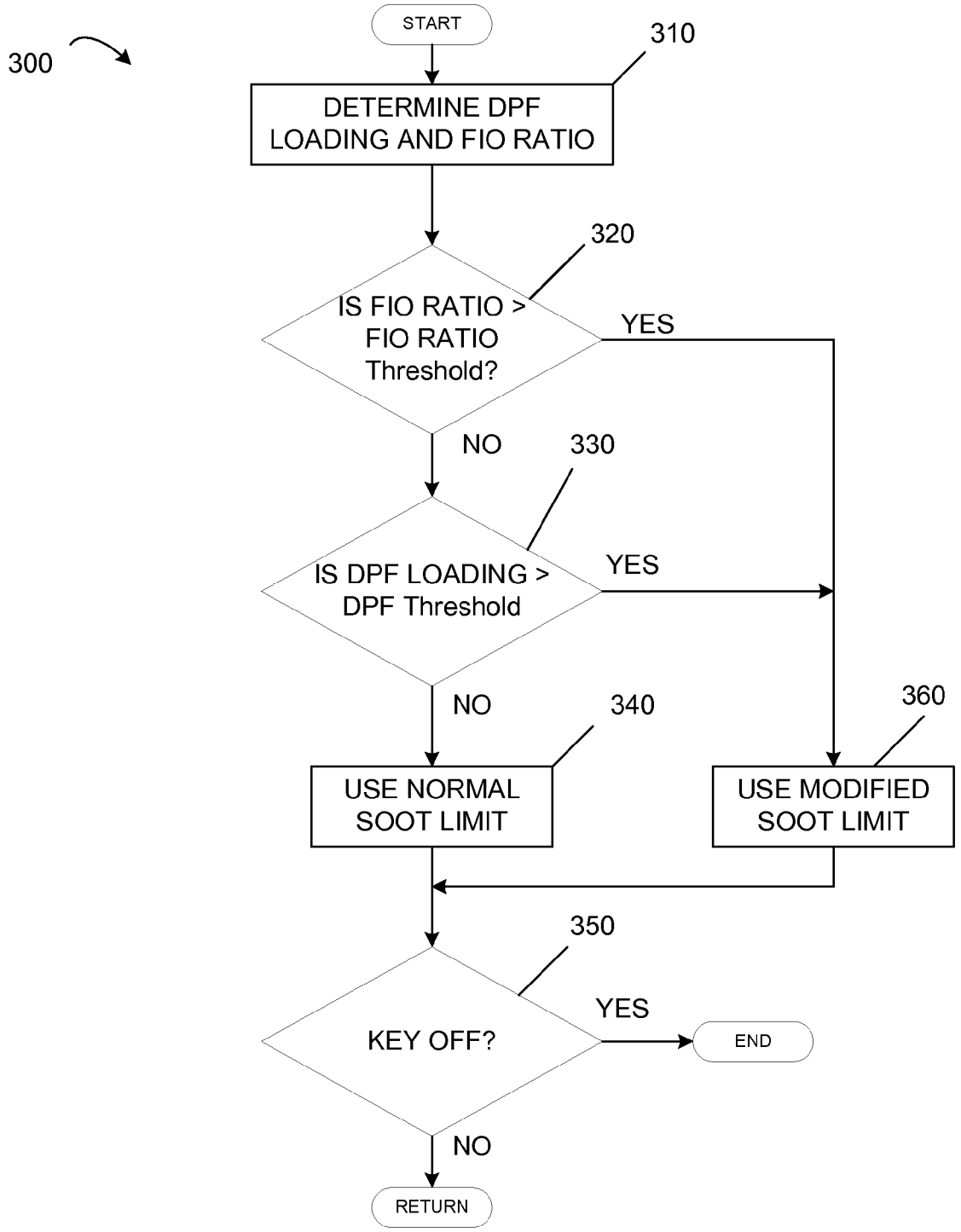
FIG. 3 is a high level flow chart of a method for controlling the diesel engine of FIG. 1 during a transient event according a further aspect of the present disclosure.

With respect to FIG. 3, the method 300 begins, in the case of a diesel engine 10 fitted to a vehicle, at a key-on event, for example when the vehicle is started by the driver 132. The method then advances to step 310 in which the current DPF loading and the current amount of fuel in the lubrication oil are determined.

The amount of fuel in the oil may be expressed as a ratio of fuel to oil or may be expressed as a volume or a mass of fuel. Similarly, the DPF loading threshold can be expressed in terms of a mass of soot, a volume of soot, a value of exhaust gas pressure or a ratio of soot to total soot storage capacity.

The determination of the current DPF loading and the current amount of fuel in the lubrication oil may be obtained directly by measurements received from sensors (not shown) associated with the diesel engine system 25 such as, for example and without limitation, an oil viscosity sensor, an oil temperature sensor, an exhaust gas pressure sensor located upstream of the DPF 27 forming part of the information 24. Alternatively, the determination of the current DPF loading and the current amount of fuel in the lubrication oil may be obtained by estimation techniques based upon the known duty cycle and running time of the engine 10. Such estimates may be in the form of data stored in the form of one or more look up tables referencing DPF loading and the amount fuel in the lubrication oil against functions of engine operation such as total running time. For example, the amount of soot in the DPF 27 can be estimated by using an instantaneous soot emission rate obtained from a look-up table and then integrating the results obtained over time.

The method then advances to step 320 where the determined current amount of fuel in the oil is compared to a predetermined threshold. In the example shown on FIG. 3 this is performed by way of the comparison of the current FIO ratio with a predetermined ratio such as for example (0.1) and if the current FIO ratio is greater than 0.1 the method branches to step 360 otherwise it continues to step 330. The FIO ratio could be a value in the range of 0.06 to 0.15.

In step 330 the current DPF loading is compared to a predetermined DPF loading threshold. Irrespective of the measurement quantity value used for comparison purposes, if the current value of DPF loading is higher than this threshold, then the method branches to step 360, otherwise it advances to step 340. In step 340 a normal threshold of soot production is selected. The normal level of soot production is the maximum level of permitted soot production which will also produce the maximum level of permitted torque from the engine 10. That is to say, a level that optimizes torque output without producing an unacceptably high level of soot production.

Figure 4:
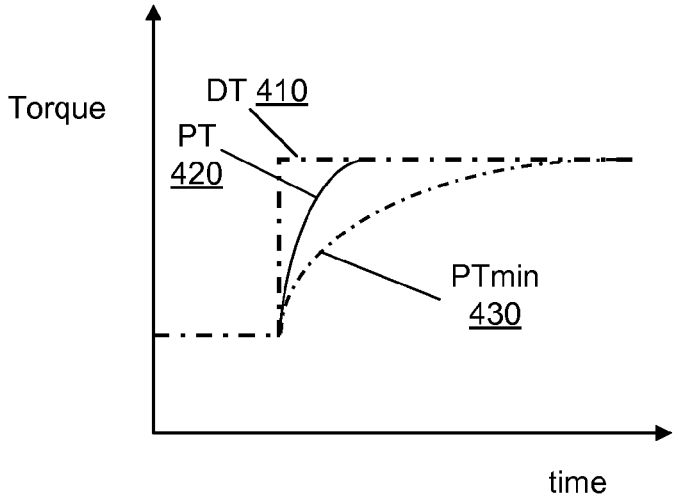
FIG. 4 is a diagrammatic chart showing the relationship between torque and time for a transient event related to the diesel engine of FIG. 1.

Referring briefly to FIG. 4, where DT 410 is a line indicating a sudden request for increased torque from the engine 10, the line PT 420 represents this normal maximum level of permitted torque.

Returning to FIG. 3, the method then advances to step 350 where it is determined whether a key-off event has occurred, if a key-off event has occurred, then the method terminates, otherwise it returns to step 310 and the method is repeated.

Referring back now to step 360 of FIG. 3, a modified soot production threshold is selected. This soot production threshold will be lower than the normal level because the aim is to reduce soot production so as to reduce the filling rate of the DPF 27 thereby extending the time period between regeneration events and also reducing the rate at which fuel is added to the lubrication oil.

In a modification of the method not shown on FIG. 3, an indication to an operator of the engine 10 may be provided when the amount of FIO exceeds the FIO threshold. This could be way of a simple indicator light or via an alphanumeric display indicating that an oil change is required.

Continuing with step 360, the modified soot threshold (permitted torque output) could be a single value or could be a variable value based upon the current soot loading of the DPF 27. The modified soot threshold could be based upon a predetermined relationship between the current state of the DPF 27 and the soot production from engine 10, or a relationship between the amount of contaminant in the lubrication oil of the engine 10 and the soot production from the engine 10, among other factors. In any case there is a lower threshold below which no further reduction is possible. This lower threshold, indicated by the line PTmin 430 on FIG. 2, is chosen such that the torque output of the engine 10 is not so severely compromised that the engine 10 will be unable to perform expected tasks. For example in the case of a motor vehicle fitted with the engine 10, the motor vehicle is to be able to pull away from a standstill on an incline, have sufficient torque for overtaking purposes and the engine 10 is to not stall easily during a normal take-off from rest.

FIG. 5 shows how the permitted torque output of the engine 10 could vary for a single operating state of the engine 10 based upon the loading of the DPF 27. The permitted torque is allowed to remain at its maximum value PTmax 510 when the DPF loading is low. PTmax 510 corresponds to the line PT 420 on FIG. 4. When the loading of the DPF 27 exceeds the DPF threshold the permitted torque is gradually reduced until at some level of loading the permitted level of torque reaches the minimum level as indicated by PTmin 520 on FIG. 5 and PTmin 430 on FIG. 4. In one nonlimiting example, for an engine to have a maximum torque output of 400 NM, PTmax is 300 NM and PTmin is 200 NM for the operating state shown in FIG. 5. Although in FIG. 5 this relationship is linear between the upper and lower thresholds of permitted torque (PTmax 510 and PTmin 520) it will be appreciated that some other non-linear relationship could be used.

It will be appreciated that a similar variable approach could be used with respect to the amount of fuel in the oil. In which case, the soot in DPF axis of FIG. 5 would be replaced by a fuel in oil axis. Alternatively, the FIO threshold could be set high so that as soon as it is exceeded the lower threshold of permitted torque PTmin 520 is used all the time.

Returning to FIG. 3, after completing step 360, the method advances to step 350. In step 350 it is determined whether a key-off event has occurred and, if it has, then the method terminates, otherwise it returns to step 310 and the method is repeated.

Although the method described above uses the amount of fuel in oil as one of the tests for determining when the production of soot needs to be reduced it will be appreciated that the current state of the oil could be deduced using another oil based contaminant parameter as an alternative to, or in combination with the FIO level.

For example, if the other contaminant is soot then the amount of soot in the oil (SIO) could be estimated or measured and used instead of the FIO or both of these parameters could be used. The measurement of the amount of soot in oil is shown, for example, in U.S. Pat. No. 7,830,509 and EP-A-1500924. As an alternative to such direct measurement techniques the amount of soot could be estimated based upon the known operating state of the engine 10 over time. High levels of soot in the oil are disadvantageous because they reduce the lubricating properties of the oil and in some cases can clog up small oil feeds or supply conduits.

Accordingly, in step 320 of FIG. 3, the test could be "Is SIO>SIO Threshold?" and if it is, the process may move on to step 360 and if it is not, the process may move to step 330. Alternatively using both tests in step 320 the test would be "Is FIO>FIO Threshold? OR is SIO>SIO Threshold?" and if either of the tests is positively met then move on to step 360 and if neither of the tests is met move on to step 330.

Furthermore, the test for the state of an emission control device set forth in step 330 has been described above as being the state of a DPF 27 in terms of the soot loading of the DPF 27 but it could relate to some other form of emission control device such as a DPF additive system having a reservoir 608 containing additive that is used to enhance regeneration of the DPF 27.

When using a DPF additive system, the additive could be added to the fuel from a supply of additive stored in an additive reservoir 608, such as in U.S. Pat. No. 5,195,466, to the exhaust gas flow upstream of the DPF 27 or directly to the DPF 27 at an inlet side. It will be appreciated that the more often the DPF 27 has to be regenerated the more additive will be used and therefore it is desirable to reduce soot production when the additive used exceeds a predetermined amount in order to extend the time period before the reservoir 608 is to be filled. Furthermore if the time periods between regeneration events is increased then the amount of additive that need to be stored on the vehicle can potentially be reduced thereby allowing the use of a smaller reservoir.

In such a case of using an additive, the state of the emission control device is the amount of additive that has been used from the reservoir 608 or the amount of additive remaining in the reservoir 608. Therefore if the amount of additive used exceeds a predetermined threshold then the soot production from the engine 10 may be reduced to reduce the frequency of regeneration and hence conserve additive. The controlling of engine 10 may be based upon a predetermined relationship between the amount of additive in the reservoir 608 and the soot production from the engine 10. Therefore the step 330 would test whether the usage of additive from the reservoir 608 exceeds the threshold and if it does proceed to step 360 but if it does not proceed to step 340.

Furthermore the test in step 330 could be a multiple test of the state of the emission control system so that for an engine 10 having a DPF 27 with additive system the test in step 330 would be "is the soot loading of the DPF>DPF soot threshold?" or "is the additive used>additive usage threshold." If either of these thresholds is exceeded, the method branches to step 360 but otherwise advances to step 340.

Similarly, the test in step 330 may be related to the status of a NOx emissions control device, such as a selective catalytic reduction (SCR) system or a lean NOx trap (LNT), and/or an associated NOx emissions control device additive system. As NOx and soot emissions are often linked, the test in step 330 may determine whether a NOx emissions device load or poisoning is greater than a predetermined threshold load or poisoning. When the load or poisoning is greater than its associated threshold, the method branches to step 360, otherwise, the method advances to step 340. If a NOx emission control device includes an additive system, the amount of additive in a NOx emissions device additive reservoir may be used to indicate additive usage, similarly to the DPF additive system discussed above. In this case, the test in step 330 would test whether the usage of additive from the NOx emissions device additive reservoir exceeds a predetermined threshold, and if it does, proceed to step 360, but if it does not, advance to step 340.

Furthermore, as described above, the test in step 330 could be a multiple test of the state of the NOx emission control system so that the test in step 330 would be "is the NOx emissions device load>NOx emissions device load threshold" or "is the NOx emissions device poisoning>NOx emissions device poisoning threshold" or "is the NOx emissions device additive used>the NOx emissions device additive usage threshold." If any of these thresholds is exceeded, the method branches to step 360, but otherwise advances to step 340. Further still, one or more of the above-described NOx tests may supplement or replace one or more of the DPF tests and oil-contaminant tests, such that any combination of the tests described in the present specification may be used to control the engine 10. As such, if any of the above-described tests or multiple tests indicate that a parameter (such as FIO, SIO, DPF load, NOx load, etc.) exceeds a threshold for that parameter, the method branches to step 360, and otherwise either proceeds to the next test or advances to step 340 if all tests have been performed.

Therefore, according to an embodiment of the present disclosure, described above is a method for reducing the frequency of DPF regeneration and reducing the rate at which fuel/soot is absorbed into the lubricating oil of the engine by adaptively varying the production of soot produced by the engine during a transient event is provided. The reduction of soot during such transient events is particularly relevant because there is more probability of high soot production during such events due to the difficulty in matching exactly the control of the engine 10 with the actual combustion taking place.

In one embodiment of the present disclosure, as the level of soot loading in the DPF 27 increases or the amount of the additive used increases, the amount of soot that can be produced by the engine 10 is lowered so as to reduce the amount of soot being flowed to the DPF 27. In an alternative embodiment, as soon as the soot loading of the DPF 27 or the usage of additive exceeds a predetermined threshold the amount of soot that can be produced is immediately cut to a level where it considerably reduces the soot flowing to the DPF 27 but there is still sufficient torque for the engine 10 to perform its basic tasks.

The variation of soot output may not be solely based upon the loading of the DPF 27; it may also be based upon the amount of fuel and/or soot in the oil of the engine 10. This is because if the DPF 27 is regenerated the soot loading will be reduced to a low level but the amount of fuel in the oil will increase due to this regeneration. Therefore, if the control of the engine 10 is based solely on DPF 27 loading, a high level of fuel in the oil could be building up and no action would be taken to reduce the rate of soot production to reduce the rate at which fuel is being added to the oil.

Figure 6:
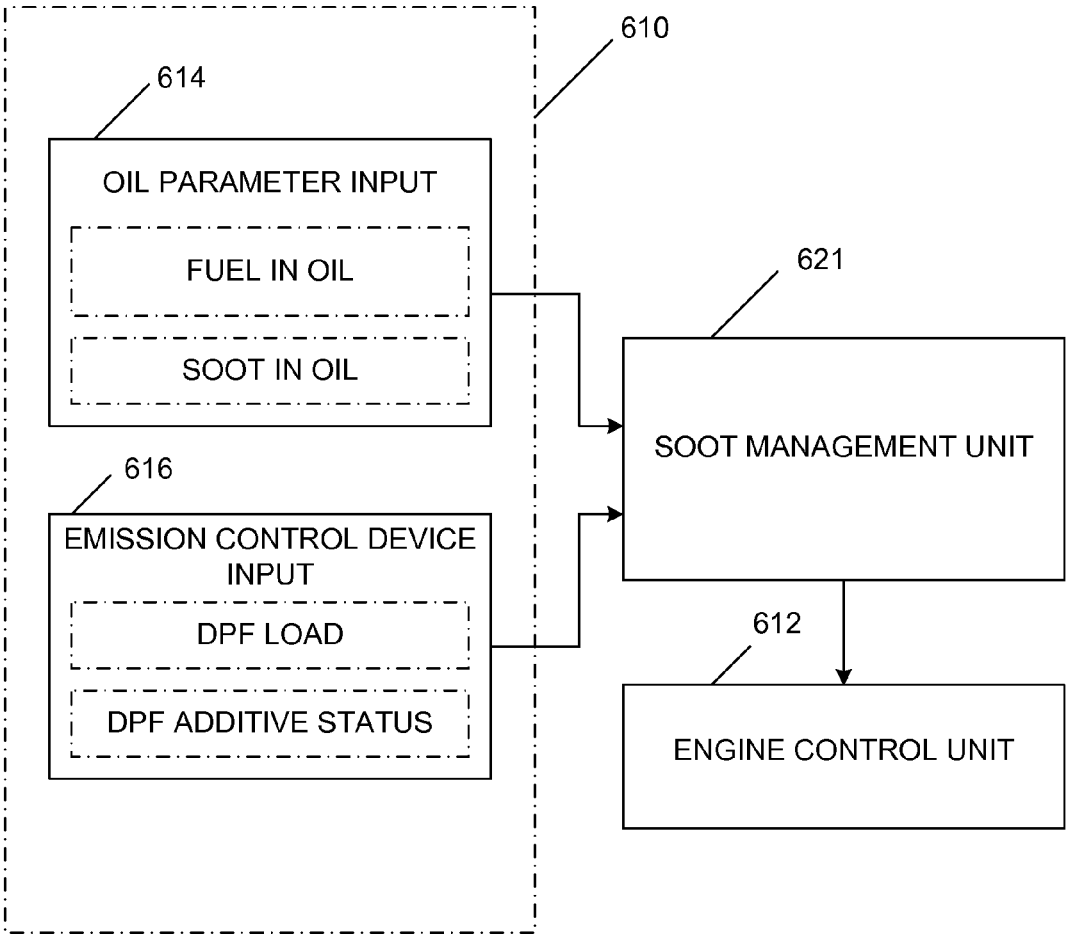
FIG. 6 is a schematic diagram of an apparatus for controlling the soot produced by the diesel engine of FIG. 1 during steady state running.
Figure 7:
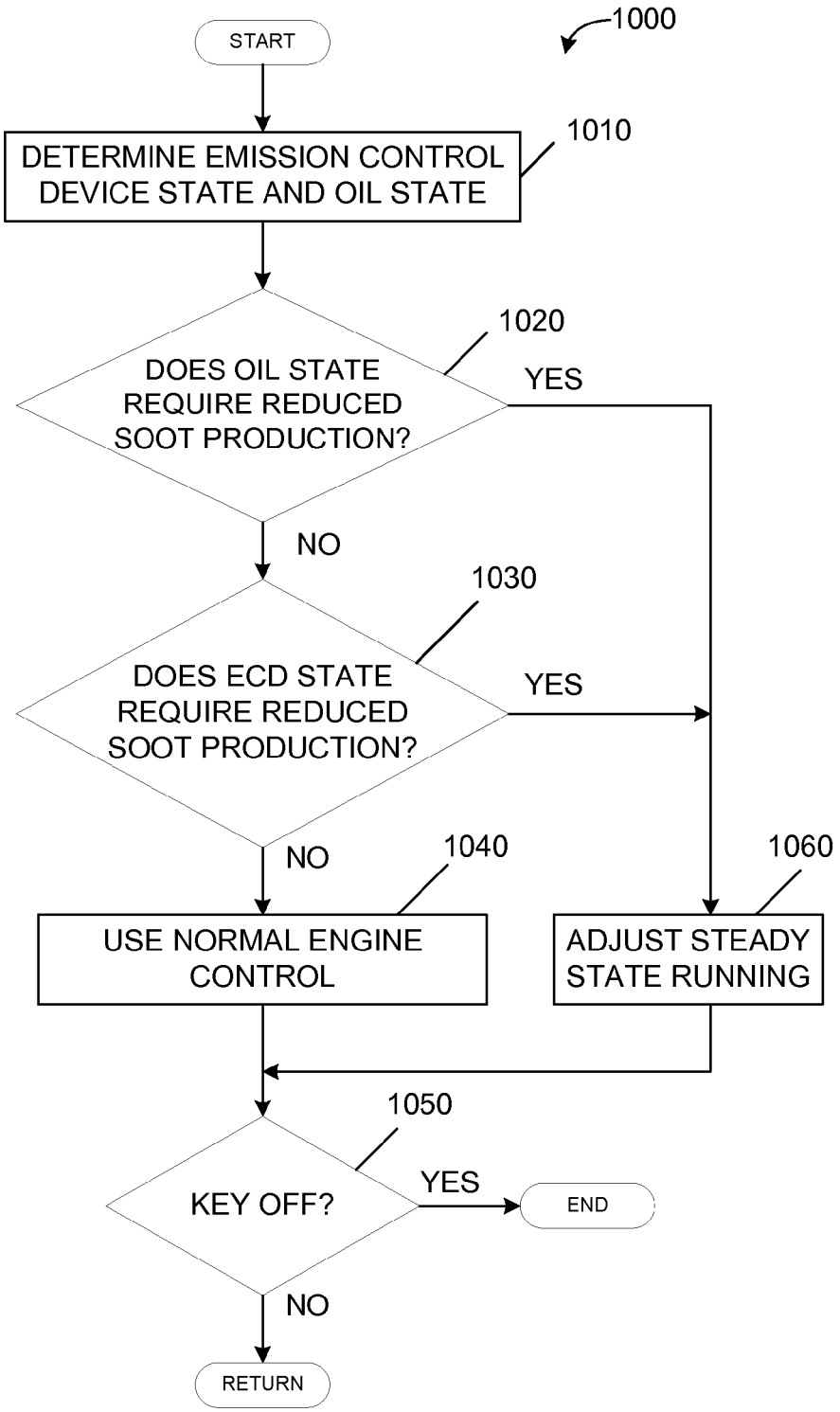
FIG. 7 is a high level flow chart of a method for controlling the diesel engine of FIG. 1 during steady state running.

Referring now to FIGS. 6 and 7 there is shown a further extension of the present disclosure to a case where the engine 10 is operating in a steady state condition.

FIG. 6 shows selected components of an apparatus for controlling/reducing the soot output from the engine 10. The apparatus has as previously described a soot management unit 621 and an engine control unit 612. In an embodiment where both transient and steady state soot reduction is employed then the soot management unit 621 and the soot management unit 21 would probably be formed as a single unit and similarly the engine control unit 612 and the engine control unit 12 would probably be formed as a single unit.

The soot management unit 621 receives a number of inputs 610 falling into two categories, namely those relating to the operating state of the oil used to lubricate the engine 10 (oil parameter input 614) and those relating to the operating state of the associated emission control device (ECD) (ECD Input 616), which in this case is a DPF 27 with additive system having an additive reservoir (608 on FIG. 2) but could in other embodiments simply be a DPF 27.

The soot management unit 621 is operable to receive the various inputs 610 which in this case comprise the amount of fuel in the oil, the amount of soot in the oil, the soot loading of the DPF 27 and the amount of additive used from a reservoir 608 forming part of the additive system, process these inputs and produce a command signal for the engine control unit 612 instructing it when required to adjust the operation of the engine 10 in order to reduce the soot output therefrom. Accordingly, the soot management unit 621 is programmed to determine whether soot output from engine 10 is to be reduced, and if soot is to be reduced, output a request for lower soot production.

It will be appreciated that the various inputs 610 could be deduced by measurement using sensor based technology or could be estimated based upon the known operation of the engine 10.

The operation of the apparatus will now be described in greater detail with reference to FIG. 7 which is a high level flow chart of the logical operations performed by the apparatus and in particular by the soot management unit 621. The method 1000 begins, in the case of a diesel engine fitted to a vehicle, at a key-on event. The method then advances to step 1010 in which the current state of the emission control device is established in terms of the current soot loading of the DPF 27, the amount of additive for the DPF 27 used from the reservoir 608 and the current state of contamination of the oil in terms of the amount of fuel and soot in the lubrication oil.

The amount of fuel/soot in the oil may be expressed as a ratio of fuel/soot to oil or may be expressed as a volume or a mass of fuel/soot in the oil. Similarly, the DPF loading threshold can be expressed in terms of a mass of soot, a volume of soot, a value of exhaust gas pressure or a ratio of soot to total soot storage capacity and the amount of additive used can be expressed as a volume, ratio of the total storage capacity of the reservoir 608 or by any other convenient means.

As discussed above, the determination of the current DPF loading, the current amount of additive used from the reservoir 608 and the current amount of fuel/soot in the lubrication oil may be obtained directly by measurements received from sensors (not shown) associated with the diesel engine system 25 or may be obtained by estimation techniques based upon the known duty cycle and running time of the engine 10. Such estimates may be in the form of data stored in the form of one or more look up tables referencing DPF loading, additive usage, the amount of soot in the oil and the amount fuel in the lubrication oil against functions of engine operation such as total running time. For example, the amount of soot in the DPF 27 can be estimated by using an instantaneous soot emission rate obtained from a look-up table and then integrating the results obtained over time.

The method then advances to step 1020 where it is determined whether the level of oil contamination requires that soot production from the engine 10 be reduced. Table 1 below shows the various relationships that could be used in step 1020 depending upon whether both soot and fuel in oil values are known or merely one of these is known and the resulting output from step 1020.

TABLE 1

| Estimated or Measured Oil Contaminant | Test in Step 1120 |
|---|---|
| Soot and Fuel | Is SIO level > SIO Threshold?<br>OR<br>Is FIO > FIO threshold |

TABLE 1-continued

| Estimated or Measured Oil Contaminant | Test in Step 1120 |
|---|---|
| | If either Yes go to 1060 else goto 1030 |
| Soot Only | Is SIO level > SIO Threshold? If Yes goto 1060 else goto 1030 |
| Fuel Only | Is FIO > FIO threshold If Yes go to 1060 else goto 1030 |

If the output is to step 1060, steady state running of the engine is adjusted to optimize the reduction of soot from the engine 10. The reduction in soot may have an adverse effect on other operating parameters of the engine 10 such as for example the maximum torque obtainable or the exhaust gas emission performance.

The adjustment to the steady state running can be accomplished using one or more adjustments to the engine 10 such as, for example and without limitation, reducing or applying a threshold to fuelling to the engine 10, adjusting the fuel timing, adjusting and/or reducing fuel quantity, adjusting and/or increasing the injection pressure, adjusting and/or reducing the exhaust gas recirculation flow, adjusting and/or increasing the air mass flow and, in the case of a boosted engine, and adjusting and/or increasing the air charge pressure. One of these adjustments may be used by the engine control unit 612 or several may be used depending upon the current operating conditions of the engine 10 and the control strategy employed by the engine control unit 612.

If the tests conducted in step 1020 result in a negative result then the method advances to step 1030 where the current state of the emission control device is tested. Table 2 below shows the various relationships that could be used in step 1030 depending upon whether both soot loading of the DPF 27 and additive levels are known or merely one of these is known and the resulting output from step 1030.

TABLE 2

| Estimated or Measured ECD State | Test in Step 1120 |
|---|---|
| Soot Loading of DPF Additive Level in Reservoir | Is DPF Soot level > DPF Soot Threshold? OR Is Additive Used > Used threshold? If either Yes go to 1060 else goto 1030 |
| Soot Loading Only | Is DPF Soot level > DPF Soot Threshold? If Yes goto 1060 else goto 1030 |
| Additive Level Only | Is Additive Used > Used threshold? If Yes go to 1060 else goto 1030 |

If the output is to step 1060, then, as before, steady state running of the engine is adjusted to optimize the reduction of soot from the engine 10 using the processes referred to above. However, if the output from step 1030 is to step 1040, a normal threshold of soot production is selected. The normal level of soot production is a maximum level of permitted soot production which will also produce the maximum level of permitted torque from the engine 10 and the most enhanced emission and fuel economy performance.

After completing steps 1040 or 1060 the method advances to step 1050. In step 1050 it is determined whether a key-off event has occurred and, if it has, then the method terminates; otherwise it returns to step 1010 and the method is repeated.

It will be appreciated that the present disclosure is not limited to the exact steps or order of processing described above and that the order of steps 1020 through 1030 could be rearranged or in the case of steps having multiple tests these tests could be carried out in separate steps.

Therefore the engine system 10 could be operated such that soot production is reduced when certain predefined thresholds have been met relating to oil contamination and/or emission control device state during steady state running, during transient running of the engine 10 or during both transient and steady state running. For example and without limitation, a first stage might be to limit soot production merely during transient operation of the engine but then when one of the various tested parameters reaches a more urgent state to also use soot reduction in the steady state running condition of the engine.

It will be appreciated that the use of soot reduction control during merely transient operation has a smaller negative effect on emission performance of the engine 10 due to the very short period of time involved but produces a significant reduction in the amount of soot produced due to the larger potential mis-match between required fuel and supplied fuel.

It will be appreciated by those skilled in the art that although the present disclosure has been described by way of example with reference to one or more embodiments it is not limited to the disclosed embodiments and that one or modifications to the disclosed embodiments or alternative embodiments could be constructed without departing from the scope of the present disclosure.

Accordingly, it will be appreciated that the configurations and methods disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method for controlling an engine system having a diesel engine, at least one emission control device and oil to lubricate the engine, the method comprising adaptively varying an operation of the engine to reduce production of soot by the engine based upon at least one of a current state of the emission control device and a current state of the oil of the engine, wherein the operation of the engine is controlled to reduce the soot produced by the engine when the current state of the emission control device exceeds a respective predetermined threshold, wherein the emission control device is a diesel particulate filter system having a supply of additive stored in an additive reservoir and the current state of the emission control device is the amount of additive in the reservoir.

2. The method of claim 1 wherein the operation of the engine is controlled to reduce the soot produced by the engine further based upon a predetermined relationship between the current state of the emission control device and the soot production from the engine.

3. The method of claim 1 wherein the current state of the emission control device further includes a soot loading of the diesel particulate filter.

4. The method of claim 1 wherein the current state of the oil is an amount of contaminant in the oil.

5. The method of claim 4 wherein the operation of the engine is controlled to reduce the soot produced by the engine based upon a predetermined relationship between the amount of contaminant in the oil and the soot production from the engine.

6. The method of claim 4 wherein the amount of contaminant in the oil is a ratio of contaminant to oil.

7. The method of claim 4 wherein the contaminant is one of fuel in the oil and soot in the oil.

8. The method of claim 1 wherein the operation of the engine is varied based upon the current state of the emission control device and the current state of the oil.

9. The method of claim 1, wherein the operation of the engine is varied by adjusting at least one of fuel timing, fuel quantity, fuel injection pressure, exhaust gas recirculation flow, air mass flow, and air charge pressure.

10. A system for controlling an engine operation, comprising:

a lubrication system directing oil to lubricate the engine;

a particulate filter; and an engine control system including non-transitory instructions executable to:

determine a current state of the particulate filter;

determine a current state of fuel in the oil; and during an engine transient condition, limiting a permitted torque of the engine to be lower than a threshold, the threshold lowered based on an increase each of a soot loading of the particulate filter and soot in the oil.

11. The system of claim 10 wherein the instructions are further executable to adjust the operation of the engine based upon a predetermined relationship between the current state of the particulate filter and a soot production from the engine.

12. The system of claim 10 wherein the instructions are further executable to reduce a production of soot from the engine when the current state of the emission control device particulate filter exceeds a predetermined threshold for that state.

13. The system of claim 10, wherein torque is limited by adjusting at least one of fuel timing, fuel quantity, fuel injection pressure, exhaust gas recirculation flow, air mass flow, and air charge pressure.

14. A method of controlling an engine, comprising:

adjusting one or more of fuel timing, fuel quantity, and fuel injection pressure based on each of a soot load on a diesel particulate filter and a ratio of fuel contamination in engine oil being greater than respective thresholds; and adjusting exhaust gas recirculation flow, air mass flow, and air charge pressure of the engine based on the soot load and ratio being greater than the respective thresholds.

* * * * *